US010739802B2

(12) United States Patent
Stanzione

(10) Patent No.: US 10,739,802 B2
(45) Date of Patent: Aug. 11, 2020

(54) LOW DROPOUT VOLTAGE REGULATOR, A SUPPLY VOLTAGE CIRCUIT AND A METHOD FOR GENERATING A CLEAN SUPPLY VOLTAGE

(71) Applicant: STICHTING IMEC Nederland, AE Eindhoven (NL)

(72) Inventor: Stefano Stanzione, Leuven (BE)

(73) Assignee: STICHTING IMEC Nederland, AE Eindhoven (NL)

( * ) Notice: Subject to any disclaimer, the term of this patent is extended or adjusted under 35 U.S.C. 154(b) by 0 days.

(21) Appl. No.: 16/506,331

(22) Filed: Jul. 9, 2019

(65) Prior Publication Data

US 2020/0012303 A1 Jan. 9, 2020

(30) Foreign Application Priority Data

Jul. 9, 2018 (EP) ..... 18182404

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC . G05F 1/465; G05F 1/575; G05F 1/56; G05F 1/569; G05F 1/571; G05F 1/565
(Continued)

(56) References Cited

U.S. PATENT DOCUMENTS 7,405,546 B2 * 7/2008 Amrani ..... G05F 1/565 323/273
7,684,878 B2 * 3/2010 Reindel ..... G06F 1/26 700/22

(Continued)

FOREIGN PATENT DOCUMENTS

EP 1635239 A1 3/2006
EP 2846212 B1 4/2019

(Continued)

OTHER PUBLICATIONS

Xin Ming et al: "A Low-Power Ultra-Fast Capacitor-Less LDO with Advanced Dynamic Push-Pull Techniques", 2011 IEEE/IFIP 19th International Conference on VLSI and System-on-Chip, Hong Kong China, Oct. 3-5, 2011.

(Continued)

*Primary Examiner* — Nguyen Tran
(74) *Attorney, Agent, or Firm* — Moser Taboada

(57) ABSTRACT

A low dropout, LDO, voltage regulator comprising: an LDO input configured to receive an input voltage signal; an LDO output configured to output an output voltage signal; an error amplifying circuit, which is configured to receive a reference signal and a feedback signal associated with the output voltage signal, the error amplifying circuit being further configured to output an error signal; an output stage, which is configured to receive the error signal and output a control signal; and an output device, which is connected to the LDO input and configured to provide the output voltage signal and which is controlled by the control signal for regulating the output voltage signal; wherein the output stage is connected to the input voltage for receiving an adaptive bias current.

8 Claims, 4 Drawing Sheets

(58) Field of Classification Search
USPC ..... 323/273–281
See application file for complete search history.

(56) References Cited

U.S. PATENT DOCUMENTS

| | | | |
|---|---|---|---|
| 8,922,179 | B2 | 12/2014 | Kadanka |
| 2006/0267562 | A1 | 11/2006 | Szepesi |
| 2014/0312867 | A1 | 10/2014 | Pulvrenti et al. |
| 2016/0349774 | A1 | 12/2016 | Easwaran et al. |

FOREIGN PATENT DOCUMENTS

| | | | |
|---|---|---|---|
| FR | 2881537 | A1 | 8/2006 |
| IN | 0564/KOL/2013 | | 11/2014 |

OTHER PUBLICATIONS

Han, Xu et al: "An Output-Capacitor-Free Adaptively Biased LDO Regulator with Robust Frequency Compensation in 0.13μm CMOS for SoC Application", ETH-Zürich, 2016 IEEE International Symposium on Circuits and Systems, Montreal, Quebec, Canada, May 22-25, 2016.

Sawan et al: "ELE6308: Microélectronique analogique et mixte—Ampop avancés", Retrieved from the Internet: http://www.groupes.polymtl.ca/ele6308/automne2012/Semaine7_AdvancedOpAmp.pdf.

Extended European Search Report in EP18182404.6, dated Jan. 17, 2019.

* cited by examiner

LOW DROPOUT VOLTAGE REGULATOR, A SUPPLY VOLTAGE CIRCUIT AND A METHOD FOR GENERATING A CLEAN SUPPLY VOLTAGE

CROSS REFERENCE TO RELATED APPLICATIONS

This application claims priority to EPC Application No. 18182404.6 filed on Jul. 9, 2018, which is incorporated herein by reference in its entirety.

TECHNICAL FIELD

The present inventive concept relates to a low dropout voltage regulator. The low dropout voltage regulator may be used in a supply voltage circuit for generating a clean supply voltage. The present inventive concept also relates to a method for generating a clean supply voltage.

BACKGROUND

When a battery is used for powering an analog circuit, a voltage switching converter may be used for DC-DC conversion for switching a voltage level provided by the battery to an appropriate level for powering the analog circuit. However, the voltage switching converter may introduce ripples in the output voltage, which may be harmful to sensitive analog circuits.

Low dropout (LDO) voltage regulators are commonly used as filters between a voltage switching converter and an analog circuit in order to remove ripples from the output voltage supplied to the analog circuit.

Typically, a LDO voltage regulator comprises an output device and a differential amplifier, which receives a fraction of the output voltage signal and a stable reference voltage. If the output voltage differs from the reference voltage, the power to the output device is changes to maintain a constant output voltage.

Preferably, LDOs should consume very little power. However, ultra-low-power LDOs have limitations in bandwidth, which result in stability issues, as well as bad transient performance and low power supply rejection ratio (PSRR).

An output stage may be arranged in between the error amplifier and the output device to improve performance of the LDO. Also, or alternatively, adaptive biasing may be used in order to make a LDO bias current proportional to a load current.

In EP1635239, circuits and methods to achieve dynamic biasing for the complete loop transfer function of a current mode voltage regulator are disclosed. The circuit comprises a Mirror-Transconductor Amplifier type operational transconductance amplifier (OTA) wherein its transconductance is linearly dependent on its biasing current. This biasing current is a linear derivative of the OTA's output current. A current amplification circuit couples the regulator output current linearly with said OTA's output current. In this configuration the iterative biasing of the OTA forms a feed-forward loop, which contains a low-pass filter for stability and a negative feedback loop is closed by connecting the regulator voltage output to the OTA input.

However, many relevant parameters of the error amplifier, such as DC-gain, settling error and PSRR are directly related to the biasing of the error amplifier. Adaptive biasing of the error amplifier will unavoidably worsen those parameters over the full range. Additionally, kickback on the reference voltage will be a severe issue in ultra-low-power applications, as the input reference will be a relatively high impedance node.

SUMMARY

An objective of the present inventive concept is to provide a low dropout (LDO) voltage regulator which is stable over a large bandwidth. In particular, an objective of the present inventive concept is to provide adaptive biasing of an LDO voltage regulator without affecting performance of the error amplifier.

These and other objectives of the present inventive concept are at least partly met by the invention as defined in the independent claims. Preferred embodiments are set out in the dependent claims.

According to a first aspect, there is provided a LDO voltage regulator comprising: an LDO input configured to receive an input voltage signal; an LDO output configured to output an output voltage signal; an error amplifying circuit, which is configured to receive a reference signal and a feedback signal associated with the output voltage signal, the error amplifying circuit being further configured to output an error signal; an output stage, which is configured to receive the error signal and output a control signal; and an output device, which is connected to the LDO input and configured to provide the output voltage signal and which is controlled by the control signal for regulating the output voltage signal; wherein the output stage is connected to the input voltage for receiving an adaptive bias current.

Thanks to the invention, a LDO voltage regulator is provided with an output stage. Further, the LDO voltage regulator is configured such that the output stage is adaptively biased, without the error amplifying circuit being adaptively biased. This implies that an LDO bias current may be proportional to a load current without the error amplifying circuit being adaptively biased. Thus, performance of the error amplifying circuit need not be affected even though the LDO voltage regulator is adaptively biased.

It should be realized that the feedback signal being associated with the output voltage signal implies that the feedback signal may be a fraction of the output voltage signal. However, according to an alternative, the feedback signal may correspond to the output voltage signal.

According to an embodiment, a bias transistor is connected to the output of the error amplifying circuit and is controlled by the error signal for providing the adaptive bias current.

Thus, the bias transistor may be connected between the error amplifying circuit and the output stage for providing an adaptive biasing of the output stage via the feedback loop of the error amplifying circuit so as to provide adaptive biasing without the error amplifying circuit being adaptively biased.

Use of the bias transistor implies that the adaptive biasing may be achieved with a very efficient implementation.

The bias transistor may have a source connected to the input voltage, a drain connected to an input of a current mirror of the output stage, and a gate connected to the error amplifying circuit such that the bias transistor is controlled by the error signal for providing the adaptive bias current.

According to an embodiment, the error amplifying circuit is a cascode amplifier.

The cascode amplifier may provide a good input-output isolation, which may contribute to a high bandwidth of the error amplifying circuit.

According to an embodiment, the error amplifying circuit is a folded cascode amplifier.

According to an embodiment, the buffer circuit comprises a current mirror and an output stage active load transistor, wherein a gate and drain of the output stage active load transistor is connected to an output of the current mirror and a source of the output stage active load transistor is connected to the LDO input, and the gate of the output stage active load transistor further being connected to the output device for providing the control signal.

This implies that an output stage of the LDO voltage regulator may be realized as a first and a second current mirrors, the second current mirror formed by the output stage active load transistor and the output device. The current mirrors may form a cascade of transconductance amplifying stages, which are adaptively biased.

The cascade amplification stages may be provided with low gain, which allows achieving a high bandwidth.

According to an embodiment, the output stage further comprises an impedance circuit, which is connected in parallel to the output stage active load transistor and which is configured to selectively provide an impedance when an output current of the LDO voltage regulator is below a threshold.

The impedance circuit may ensure that when output current is lowered, loop gain of the LDO voltage regulator may be reduced. This implies that, even if current in the output stage active load transistor comes close to leakage, such that the transconductance reduces more than a load current, the impedance circuit ensures that loop gain is not increased. Thus, the LDO voltage regulator would not become instable for small output currents.

According to an embodiment, the impedance circuit comprises a control transistor, which is configured to control a current through the impedance circuit, the impedance circuit further comprising a diode-connected transistor connected to the control transistor.

The control transistor may receive an analog driving signal. The driving signal may imply that the control transistor functions similar to a switch, but since it is an analog driving signal the control transistor may not be discretely switched on or off. However, when the output current is lowered, the control transistor may be increasingly on so as to activate the diode-connected transistor and provide an impedance in parallel to the output stage active load transistor.

According to an embodiment, the diode-connected transistor has a lower threshold voltage than the output stage active load transistor.

When the impedance circuit is active, a current ratio between the output device and the diode-connected transistor should be smaller than a current ratio between the output device and the output stage active load transistor. This may be achieved by implementing the diode-connected transistor as low threshold voltage transistor. Thus, an area-efficient implemented may be provided.

However, according to another embodiment, the diode-connected transistor has a larger area than the output stage active load transistor. This could also ensure that the desired current ratio is achieved.

According to an embodiment, the LDO voltage regulator further comprising a current source connected to the LDO output.

If the load current goes to zero, the LDO voltage regulator may become unstable. Having a current source connected to the LDO output may ensure that, while having adaptive bias, for zero load current, the current in the LDO output does not go to zero. Thus, the current source may ensure stability of the LDO voltage regulator even for zero load current. The current of the current source is part of the quiescent current of the LDO voltage regulator.

According to a second aspect, there is provided a supply voltage circuit for generating a clean supply voltage, said supply voltage circuit comprising: a switching converter, which is configured to convert a voltage level of a source of direct current; a LDO voltage regulator according to the first aspect, which is configured to receive the input voltage signal from the switching converter and remove noise of the input voltage signal to output a cleaned output voltage signal.

Effects and features of this second aspect are largely analogous to those described above in connection with the first aspect. Embodiments mentioned in relation to the first aspect are largely compatible with the second aspect.

The supply voltage circuit including the LDO voltage regulator may ensure that noise or ripple may be avoided or at least substantially reduced in an output supply voltage. This implies that the supply voltage circuit may be particularly suitable for powering of sensitive analog circuitry.

According to a third aspect, there is provided a biomedical sensor device comprising the LDO voltage regulator according to the first aspect or the supply voltage circuit according to the second aspect.

Effects and features of this third aspect are largely analogous to those described above in connection with the first and second aspects. Embodiments mentioned in relation to the first and second aspects are largely compatible with the third aspect.

The LDO voltage regulator and/or the supply voltage circuit may advantageously be used in a biomedical sensor device for powering analog circuitry which may be used in the biomedical sensor device. Thus, such analog circuitry of the biomedical sensor device may be provided with a supply voltage, in which noise or ripple may be avoided or at least substantially reduced.

According to a fourth aspect, there is provided a method for generating a clean supply voltage, said method comprising: receiving an input voltage signal to a low dropout, LDO, voltage regulator and generating an output voltage signal from the LDO voltage regulator; feeding back the output voltage signal to an error amplifying circuit for outputting an error signal; providing the error signal and an adaptive bias current to a output stage for outputting a control signal; and receiving the control signal by an output device, which receives the input voltage signal and outputs the output voltage signal under control by the control signal.

Effects and features of this fourth aspect are largely analogous to those described above in connection with the first, second and third aspects. Embodiments mentioned in relation to the first, second and third aspects are largely compatible with the fourth aspect.

The method may make use of the LDO voltage regulator to ensure that ripple or noise on the input voltage signal may be removed or substantially reduced for output of a constant supply voltage.

BRIEF DESCRIPTION OF THE DRAWINGS

The above, as well as additional objects, features and advantages of the present inventive concept, will be better understood through the following illustrative and non-limiting detailed description, with reference to the appended drawings. In the drawings like reference numerals will be used for like elements unless stated otherwise.

DETAILED DESCRIPTION

Figure 1:
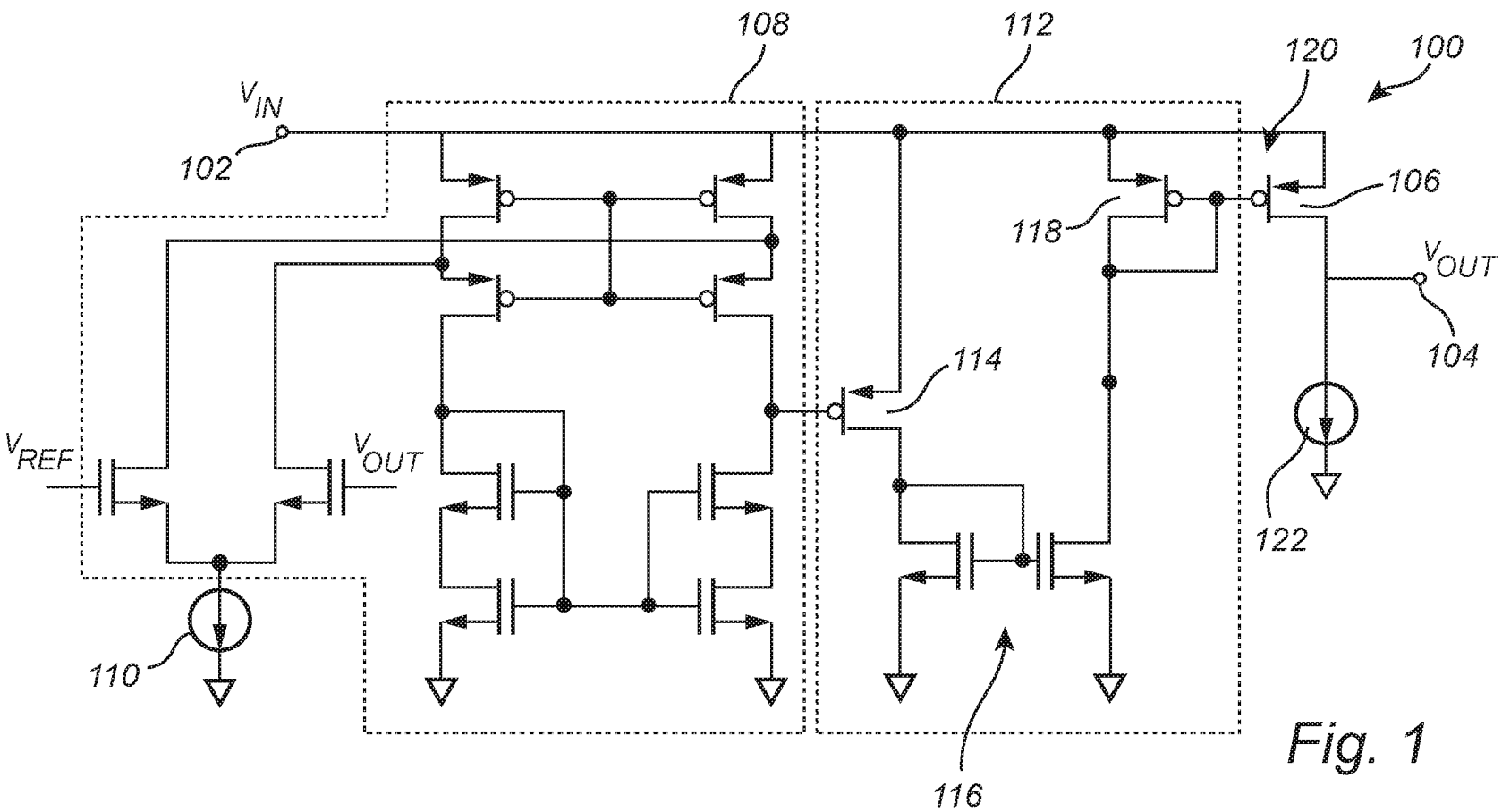
FIG. 1 is a schematic view of a low dropout voltage regulator according to a first embodiment.

Referring now to FIG. 1, a low dropout (LDO) voltage regulator 100 according to a first embodiment will be described.

As illustrated in FIG. 1, the LDO voltage regulator 100 comprises an LDO input 102, which may be connected to external circuitry for receiving an input voltage signal $V_{in}$. The LDO voltage regulator 100 further comprises an LDO output 104, which may be connected to a load for providing an output voltage signal $V_{out}$. The LDO input 102 may be connected to any circuitry providing an input voltage signal $V_{in}$ and the LDO voltage regulator 100 may act to remove or reduce noise in the input voltage signal $V_{in}$ in order to provide a constant output voltage signal $V_{out}$ to the load.

The LDO voltage regulator 100 comprises an output device 106. The output device 106 may be implemented as an output device transistor 106 forming a pass device. The output device transistor 106 may have a source connected to the LDO input 102 and a drain connected to the LDO output 104. The output device transistor 106 may further be configured to receive a control signal on a gate of the output device transistor 106 for controlling the output device transistor 106 in dependence of a variation in the output voltage signal $V_{out}$ so as to drive the output device transistor 106 to maintain a constant output voltage signal $V_{out}$.

The LDO voltage regulator 100 further comprises an error amplifying circuit, generally denoted 108 in FIG. 1. The error amplifying circuit 108 is configured to receive a feedback signal, here indicated as the error amplifying circuit 108 receiving the output voltage signal $V_{out}$. However, it should be realized that the error amplifying circuit 108 may be configured to receive a feedback signal that is associated with the output voltage signal $V_{out}$ in a known manner. For instance, the error amplifying circuit 108 may receive a fraction of the output voltage signal $V_{out}$ as achieved by two voltage dividing resistors, the error amplifying circuit 108 being connected to receive a feedback signal corresponding to the voltage over one of the resistors.

The error amplifying circuit 108 is further configured to receive a reference signal $V_{ref}$ from a stable voltage reference. The error amplifying circuit 108 is hence configured to compare the feedback signal to the voltage reference signal $V_{ref}$. The error amplifying circuit 108 may form a differential amplifier which outputs an error signal in dependence of the difference between the feedback signal and the voltage reference signal $V_{ref}$.

The error amplifying circuit 108 is illustrated in FIG. 1 as a folded cascode amplifier. However, it should be realized that the error amplifying circuit 108 may be implemented as any cascode amplifier or even as any type of differential amplifying circuit for providing the error signal in dependence of the difference between the feedback signal and the voltage reference signal $V_{ref}$.

The error amplifying circuit 108 may be connected to a current source 110 for providing a fixed biasing current of the error amplifying circuit 108.

Many parameters, such as DC gain, settling error and power supply rejection ratio, of the error amplifying circuit 108 may be related to the biasing of the error amplifying circuit 108. Thanks to the error amplifying circuit 108 being provided with a fixed biasing current, the LDO voltage regulator 100 may provide stable operation by the error amplifying circuit 108. Further, in comparison to an adaptive biasing of the error amplifying circuit 108, the fixed biasing of the error amplifying circuit 108 may ensure that kick-back noise on the reference voltage $V_{ref}$ caused by an input reference forming a relatively high impedance node is avoided or substantially reduced.

The LDO voltage regulator 100 further comprises an output stage 112. The output stage 112 is configured to receive the error signal from the error amplifying circuit 108. Further, the output stage 112 is configured to output the control signal on the gate of the output device transistor 106 for controlling the output device transistor 106.

The output stage 112 may be adaptively biased, which may increase a bandwidth of the LDO voltage regulator 100.

The output stage 112 may comprise a bias transistor 114. The bias transistor 114 may have a gate connected to the output of the error amplifying circuit 108 for receiving the error signal on the gate of the bias transistor 114. The bias transistor 114 may have a source connected to the LDO input 102.

The bias transistor 114 may thus be controlled by the error amplifying circuit 108 to provide an adaptive bias current to the output stage 112.

The output stage 112 may further comprise a first current mirror 116. The drain of the bias transistor 114 may be connected to an input of the first current mirror 116.

The first current mirror 116 may have an output connected to an output stage active load transistor 118. A gate and drain of the output stage active load transistor 118 may be connected to the output of the first current mirror 116. Further, the source of the output stage active load transistor 118 may be connected to the LDO input 102. The gate of the output stage active load transistor may further be connected to the gate of the output device transistor 106, which receives the control signal from the output stage 112.

The output stage active load transistor 118 and the output device transistor 106 may thus form a second current mirror 120.

An output stage of the LDO voltage regulator 100 is thus realized as a couple of current mirrors 116, 120, forming a cascade of transconductance amplifying stages. The connection of the current mirrors 116, 120 to the bias transistor 112, via the error amplifying feedback loop, will make the output stage of the LDO voltage regulator 100 adaptively biased, while the error amplifying circuit 108 is not adaptively biased. Further, the cascade of transconductance amplifying stages may provide a low gain, which enables achieving a high bandwidth of the LDO voltage regulator 100.

The LDO voltage regulator 100 may further comprise a current source 122. The current source 122 may be connected to the LDO output 104.

The current source 122 connected to the LDO output 104 may ensure that, for zero load current, the current in the LDO output 104 does not go to zero. Thus, the current source may ensure or improve stability of the adaptively biased LDO voltage regulator 100 even for zero load current. The current of the current source becomes part of the quiescent current of the LDO voltage regulator 100.

The current provided by the current source 122 may be larger than the leakage current of the output device transistor 106. Further, the current provided by the current source 122 may also be large enough in order to avoid that the adaptive biasing current gets so low as to get comparable to leakage current (making the blocks adaptively biased unreliable).

Figure 2:
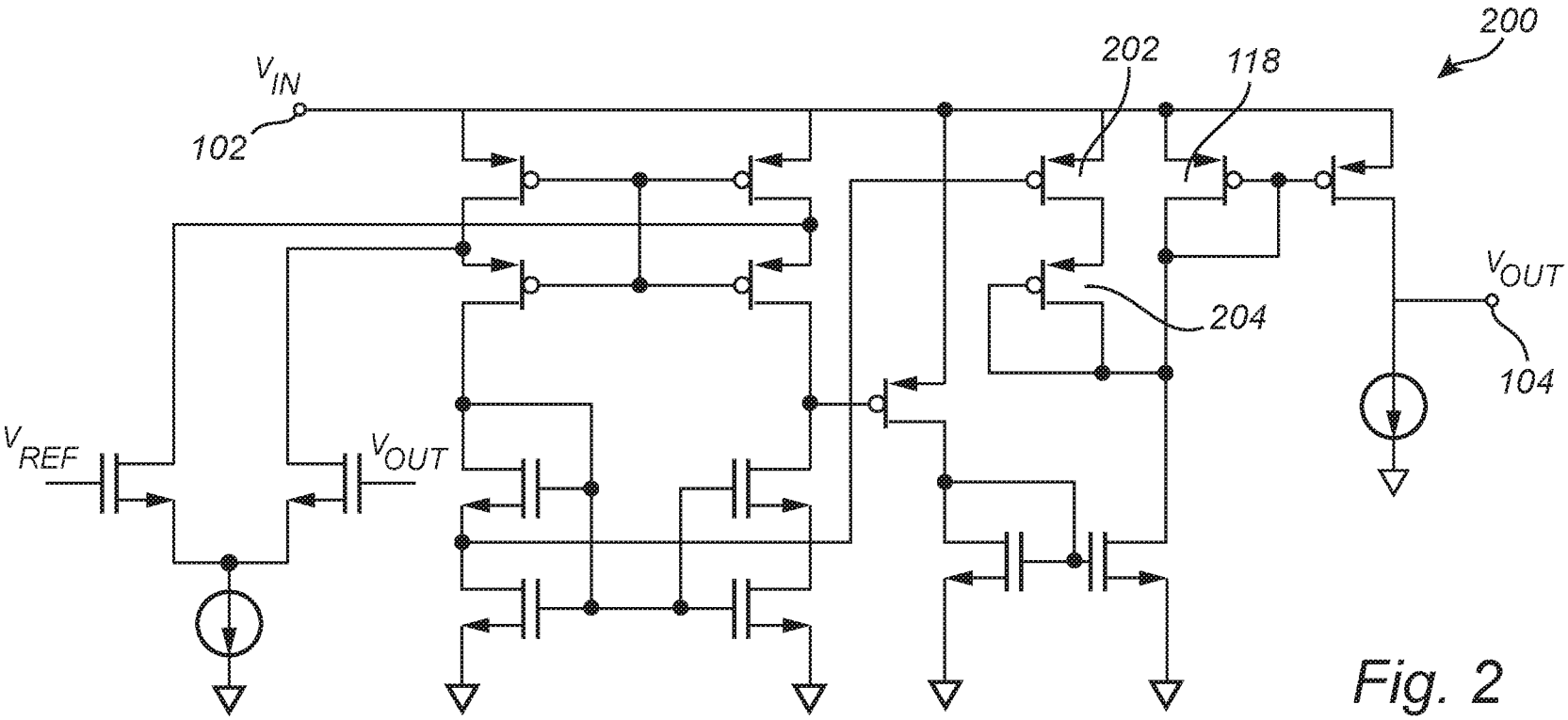
FIG. 2 is a schematic view of a low dropout voltage regulator according to a second embodiment.

Referring now to FIG. 2, a LDO voltage regulator 200 according to a second embodiment will be described. The two embodiments of the LDO voltage regulator 100, 200 are very similar and, below, mainly the differences between the embodiments are described. It should be realized that, unless specifically indicated, features described in relation to the first embodiment may also apply to the second embodiment.

The LDO voltage regulator 200 shown in FIG. 2 is specifically adapted for providing stability at extremely low current levels.

When the current in the output stage active load transistor 118 gets too close to leakage, the transconductance of the output stage active load transistor 118 would reduce more than what the load current would do. This would lead to an increase of loop gain and then to instability.

In order to improve stability of the LDO voltage regulator 200 at low current levels, an additional diode may be inserted at low current levels in parallel with the output stage active load transistor 118 of the output stage.

This may be advantageously achieved using a folded cascode error amplifying circuit 108 as illustrated in FIG. 2, wherein the folded cascode error amplifying circuit 108 provides a driving signal to a gate of a control transistor 202. The control transistor 202 may be connected in series with a diode-connected transistor 204. The control transistor 202 and the diode-connected transistor 204 together form an impedance circuit which is connected in parallel to the output stage active load transistor 118.

The control transistor 202 may function similar to a switch such that, as the load current goes down, the driving signal increasingly activates the control transistor 202 to turn on the control transistor 202. Thus, for low current levels, the diode-connected transistor 204 provides an impedance in parallel to the output stage active load transistor 118 in order to reduce the loop gain.

When the impedance circuit is active, a current ratio between the output device transistor 106 and the diode-connected transistor 204 should be smaller than a current ratio between the output device transistor 106 and the output stage active load transistor 118. This may be achieved by implementing the diode-connected transistor 204 as a low threshold voltage transistor. Thus, an area-efficient implementation with small parasitic capacitance may be provided.

However, the diode-connected transistor 204 may additionally or alternatively have a larger area than the output stage active load transistor 118. This could additionally or alternatively ensure that the desired current ratio is achieved.

Figure 3:
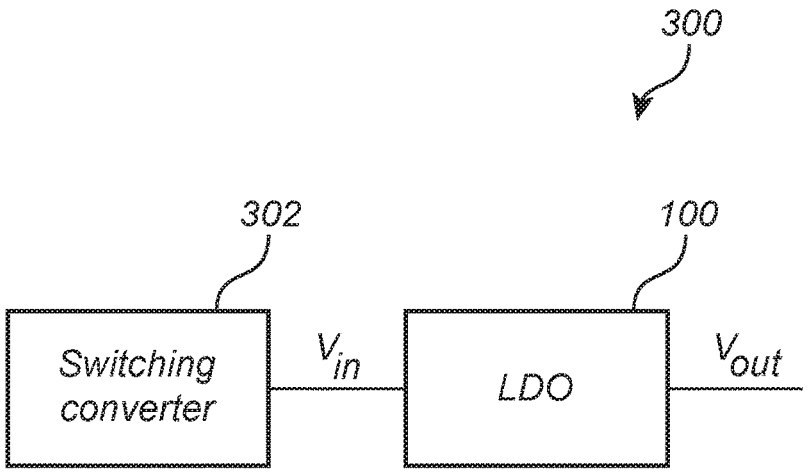
FIG. 3 is a schematic view of a supply voltage circuit according to an embodiment.

Referring now to FIG. 3, a supply voltage circuit 300 is illustrated. Although it is indicated in FIG. 3 that the LDO voltage regulator 100 according to the first embodiment is used, it should be realized that the LDO voltage regulator 200 according to the second embodiment may be alternatively used.

The supply voltage circuit 300 may be configured to provide a supply voltage to an analog circuit. The supply voltage circuit 300 may advantageously be used for powering of any circuit having a sensitive analog interface.

The supply voltage circuit 300 may be connected to a battery and the supply voltage circuit 300 may thus be suitably used in any battery-powered device, e.g. portable or wearable electronic devices.

The supply voltage circuit 300 may comprise a switching converter 302, which may be connected e.g. to a battery and may be arranged to provide a DC-DC conversion. The DC-DC conversion of the switching converter may introduce noise or ripple into a voltage signal.

Figure 5:
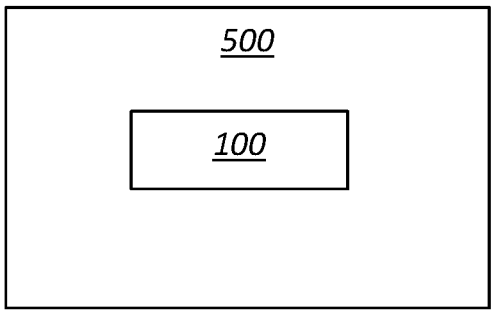
FIG. 5 is a schematic view of a biomedical sensor device comprising a low dropout voltage regulator of FIG. 1, according to an embodiment.
Figure 6:
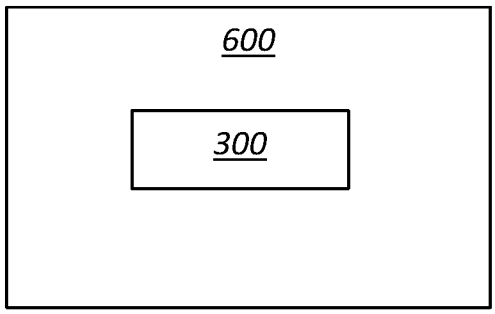
FIG. 6 is a schematic view of a biomedical sensor device comprising a supply voltage circuit of FIG. 3, according to an embodiment.

The LDO voltage regulator 100 may thus be connected to receive the voltage signal output by the switching converter 302 as an input voltage $V_{in}$. The LDO voltage regulator 100 may thus be used for removing or reducing noise of the input voltage signal such that a constant output voltage may be provided from the LDO voltage regulator 100 which may be advantageously used in powering a device having sensitive analog interface. For instance, the LDO voltage regulator 100 may be used in a biomedical sensor device 500 of FIG. 5, wherein sensitive analog circuitry may be present and may be powered via the LDO voltage regulator 100. According to another example, the supply voltage circuit 300 is used in a biomedical sensor device 600 of FIG. 6.

Figure 4:
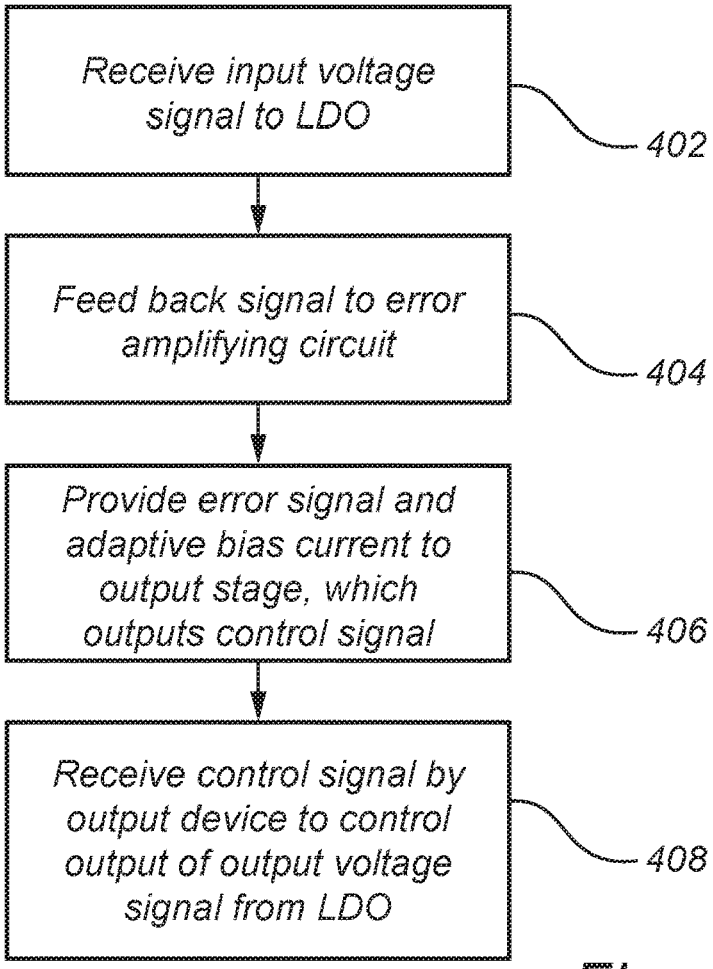
FIG. 4 is a flowchart of a method according to an embodiment.

Referring now to FIG. 4, a method for generating a clean supply voltage will be described. The method may be implemented by the LDO voltage regulator according to the first or second embodiment described above.

The method comprises receiving 402 an input voltage signal to a LDO voltage regulator, which is configured to output an output voltage signal.

The method further comprises feeding 404 a signal associated with the output voltage signal back to an error amplifying circuit. The signal fed back to the error amplifying circuit may e.g. be the output voltage signal or a fraction of the output voltage signal. The error amplifying circuit may thus output an error signal.

The method further comprises providing 406 the error signal and an adaptive bias current to an output stage, which outputs a control signal. The Thus, the output stage is adaptively biased for providing a large bandwidth of the LDO voltage regulator.

The method further comprises receiving 408 the control signal by an output device of the LDO voltage regulator. The output device may receive the input voltage signal and output the output voltage signal under control by the control signal, e.g. by the output device being implemented as an output device transistor having a source connected to receive the input voltage signal and a drain connected to output the output voltage signal and a gate connected to receive the control signal.

In the above the inventive concept has mainly been described with reference to a limited number of examples. However, as is readily appreciated by a person skilled in the art, other examples than the ones disclosed above are equally possible within the scope of the inventive concept, as defined by the appended claims.

The invention claimed is:

1. A low dropout (LDO) voltage regulator comprising:

an LDO input configured to receive an input voltage signal;

an LDO output configured to output an output voltage signal;

an error amplifying circuit, which is configured to receive a reference signal and a feedback signal associated with the output voltage signal, the error amplifying circuit being further configured to output an error signal;

an output stage, which is configured to receive the error signal and output a control signal; and an output device, which is connected to the LDO input and configured to provide the output voltage signal and which is controlled by the control signal for regulating the output voltage signal, wherein the output stage is connected to the LDO input for receiving an adaptive bias current, and wherein the output stage comprises:

a current mirror and an output stage active load transistor, wherein a gate and drain of the output stage active load transistor is connected to an output of the current mirror and a source of the output stage active load transistor is connected to the LDO input, and the gate of the output stage active load transistor further being connected to the output device for providing the control signal, and an impedance circuit, which is connected in parallel to the output stage active load transistor and which is configured to selectively provide an impedance when an output current of the LDO voltage regulator is below a threshold, wherein the impedance circuit comprises a control transistor, which is configured to control a current through the impedance circuit, the impedance circuit further comprising a diode-connected transistor connected to the control transistor, the diode-connected transistor having a lower threshold voltage than the output stage active load transistor.

2. The LDO voltage regulator according to claim 1, wherein a bias transistor is connected to the output of the error amplifying circuit and is controlled by the error signal for providing the adaptive bias current.

3. The LDO voltage regulator according to claim 1, wherein the error amplifying circuit is a cascode amplifier.

4. The LDO voltage regulator according to claim 1, further comprising a current source connected to the LDO output.

5. A supply voltage circuit for generating a clean supply voltage, said supply voltage circuit comprising:

a switching converter, which is configured to convert a voltage level of a source of direct current; and a LDO voltage regulator according to claim 1, which is configured to receive the input voltage signal from the switching converter and remove noise of the input voltage signal to output a cleaned output voltage signal.

6. A biomedical sensor device comprising the LDO voltage regulator according to claim 1.

7. A biomedical sensor device comprising the supply voltage circuit according to claim 5.

8. A method for generating a clean supply voltage, said method comprising:

receiving an input voltage signal to a low dropout (LDO) voltage regulator and generating an output voltage signal from the LDO voltage regulator;

feeding back the output voltage signal to an error amplifying circuit for outputting an error signal;

providing the error signal and an adaptive bias current to an output stage for outputting a control signal; and receiving the control signal by an output device, which receives the input voltage signal and outputs the output voltage signal under control by the control signal, wherein the output stage is connected to an LDO input voltage for receiving an adaptive bias current, and wherein the output stage comprises:

a current mirror and an output stage active load transistor, wherein a gate and drain of the output stage active load transistor is connected to an output of the current mirror and a source of the output stage active load transistor is connected to the LDO input, and the gate of the output stage active load transistor further being connected to the output device for providing the control signal, and an impedance circuit, which is connected in parallel to the output stage active load transistor and which is configured to selectively provide an impedance when an output current of the LDO voltage regulator is below a threshold, wherein the impedance circuit comprises a control transistor, which is configured to control a current through the impedance circuit, the impedance circuit further comprising a diode-connected transistor connected to the control transistor, the diode-connected transistor having a lower threshold voltage than the output stage active load transistor.

* * * * *